US012442250B2

(12) United States Patent
Law

(10) Patent No.: US 12,442,250 B2
(45) Date of Patent: Oct. 14, 2025

(54) BLASTHOLE DRILL COMPRESSOR DRIVE SYSTEM

(71) Applicant: SANDVIK MINING AND CONSTRUCTION USA, LLC, Alachua, FL (US)

(72) Inventor: Arnold Roberson Law, Gainesville, FL (US)

(73) Assignee: Sandvik Mining and Construction USA, LLC, Alachua, FL (US)

( * ) Notice: Subject to any disclaimer, the term of this patent is extended or adjusted under 35 U.S.C. 154(b) by 54 days.

(21) Appl. No.: 18/135,812

(22) Filed: Apr. 18, 2023

(65) Prior Publication Data

US 2023/0340836 A1 Oct. 26, 2023

Related U.S. Application Data

(60) Provisional application No. 63/333,793, filed on Apr. 22, 2022.

(51) Int. Cl.

| | |
|---|---|
| ***E21B 7/02*** | (2006.01) |
| ***F04C 15/00*** | (2006.01) |
| ***F04C 28/06*** | (2006.01) |

(52) U.S. Cl.

CPC ..... *E21B 7/022* (2013.01); *E21B 7/025* (2013.01); *F04C 15/0061* (2013.01); *F04C 28/06* (2013.01); *F04C 2270/051* (2013.01)

(58) Field of Classification Search

USPC ..... 173/8

See application file for complete search history.

(56) References Cited

U.S. PATENT DOCUMENTS

| | | | | |
|---|---|---|---|---|
| 2,048,072 | A | 7/1936 | Johansen | |
| 3,670,831 | A | 6/1972 | Winter et al. | |
| 6,009,953 | A | 1/2000 | Laskaris et al. | |
| 8,646,549 | B2 | 2/2014 | Ledbetter et al. | |
| 2007/0246262 | A1* | 10/2007 | Brookover | E21B 21/16 175/122 |
| 2010/0158702 | A1 | 6/2010 | Colavincenzo | |
| 2011/0083903 | A1* | 4/2011 | Ledbetter | E21B 21/16 192/85.01 |
| 2016/0040491 | A1 | 2/2016 | Law et al. | |

* cited by examiner

*Primary Examiner* — Chinyere J Rushing-Tucker
(74) *Attorney, Agent, or Firm* — Corinne R. Gorski

(57) ABSTRACT

A compressor drive system is arranged to selectively operate a compressor and engine of a drill rig. The compressor drive system includes a connection assembly coupled between the engine and the compressor. The connection assembly includes a ring gear arranged to be coupled to the compressor and a clutch arranged to be connected to the engine, wherein a starter is connected to the ring gear and arranged to engage the ring gear to rotate the compressor to a predetermined rotation speed before the clutch is engaged.

13 Claims, 7 Drawing Sheets

BLASTHOLE DRILL COMPRESSOR DRIVE SYSTEM

RELATED APPLICATION DATA

This application claims priority of U.S. Provisional Application No. 63/333,793, filed Apr. 22, 2022, which the entirety thereof is incorporated herein by reference.

TECHNICAL FIELD

The present disclosure relates to a blasthole drill compressor system and more particularly to a fuel saving compressor drive system having a connection assembly utilizing a clutch with a rotating speed matcher.

BACKGROUND

Blasthole drill rigs are used in surface and underground mining operations to drill a pattern of holes into a rock mass for receiving explosives. The blasthole drill rigs typically use an air compressor driven by the rig engine to provide compressed air to the drill bit, for example, to flush cuttings from the drilled hole.

Powering of the air compressor with the engine is problematic as the engine consumes a significant amount of power to provide power to the compressor. The air compressor is the largest power consumer on the blasthole drill. This is exemplified during standby operations, where energy and fuel is wasted by the compressor because the engine is still providing power to the compressor, even though the compressor is not providing air to the drill bit. The air compressor can use 70% of the full power in standby. A standard system can use hundreds to thousands of liters of diesel fuel in standby.

Attempts to solve the fuel and energy consumption power issue include using a clutch to disconnect the air compressor from the engine during a standby condition. As shown in FIG. 1, in a standard diesel engine the air compressor 18' is connected to engine 14' by a compressor fly wheel housing adapter 19' that mates with the engine fly wheel housing.

There are many different types of clutches. For example, it is known to use a wet clutch system to reduce wear of the clutch plates. Such a lubricated clutch reduces wear by cooling the clutch plates with hydraulic fluid. However, wet clutches are difficult to replace and require more parts. The wet clutch needs hydraulic oil to lubricate the clutch plates, which in turn requires a cooler and a reservoir for the oil.

The clutch can also be a dry clutch, which eliminates the complications of the cooling oil required by a wet clutch. However, a dry clutch has the disadvantage of an increased and higher rate of wear due to the numerous start/stop cycles. Moreover, inertia and friction of the compressor at starting will cause slippage resulting in increased wear on the dry plates while bringing the compressor up to engine speed.

The use of a clutch to disengage and engage creates the issue of wear and replacement expense.

The engine and clutch operate at different speeds during startup of the compressor. Only once the compressor is up to the same rpm of the engine is there no frictional wear.

In lieu of a clutch, a torque converter or fluid coupling can be used whereby torque from the engine is transmitted to the compressor by means of a pump and turbine wheel. The issue of mechanical wear is decreased; however, such a system requires expensive components and control.

Thus, there is a need for an engine/compressor coupling system or connection assembly that reduces fuel, wasted energy and wear of parts.

SUMMARY

The present compressor drive system uses a connection assembly having a dry clutch coupled with a RPM/rev matcher assembly that turns the compressor at the same speed of the engine when the clutch is engaged, thus reducing wear of the dry clutch. As the compressor is brought up to the engine rotating speed by a hydraulic or electric system, the clutch is engaged and there is no wear.

A power take-off (PTO) dry clutch with a standard hydraulic or electric engine starter is a simpler and lower cost solution than a wet clutch or a torque converter. However, without the rotational speed matching operation, the clutch would wear out and need replacing.

As noted above, the present compressor drive system includes a compressor startup. The hydraulic pumps used on the drill are always connected to the engine and will provide hydraulic power to the compressor starting system. Thus, another feature of this system is that the diesel engine starting system will not have to turn on the compressor during startup since it has its own starting system.

According to an aspect of the present disclosure, there is provided a drill rig including an engine, a compressor, and a connection assembly coupled between the engine and the compressor, the connection assembly including a ring gear coupled to the compressor and a clutch connected to the engine, wherein a starter is connected to the ring gear and arranged to engage the ring gear to rotate the compressor to a predetermined rotation speed before the clutch is engaged.

According to an aspect of the present disclosure, there is provided a compressor drive system arranged to selectively operate a compressor and engine of a drill rig, the compressor drive system including a connection assembly coupled between the engine and the compressor, the connection assembly including a ring gear arranged to be coupled to the compressor and a clutch arranged to be connected to the engine, wherein a starter is connected to the ring gear and arranged to engage the ring gear to rotate the compressor to a predetermined rotation speed before the clutch is engaged.

According to an aspect of the present disclosure, there is provided a method of controlling fuel and energy consumption and component wear in a drill rig, the drill rig including an engine and a compressor, the method including the steps of: providing a connection assembly coupled between the engine and the compressor, the connection assembly including a ring gear arranged to be coupled to the compressor and a clutch arranged to be connected to the engine, wherein a starter is connected to the ring gear and arranged to engage the ring gear to rotate the compressor to a predetermined rotation speed, starting the starter to engage the ring gear and start rotating the compressor, sensing the rotation speed of the compressor, sensing the rotation speed of the engine, determining when the rotation speed of engine and compressor are within a desired differential speed tolerance, and sending a control signal to a hydraulic valve to drive the clutch to an engaged position.

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
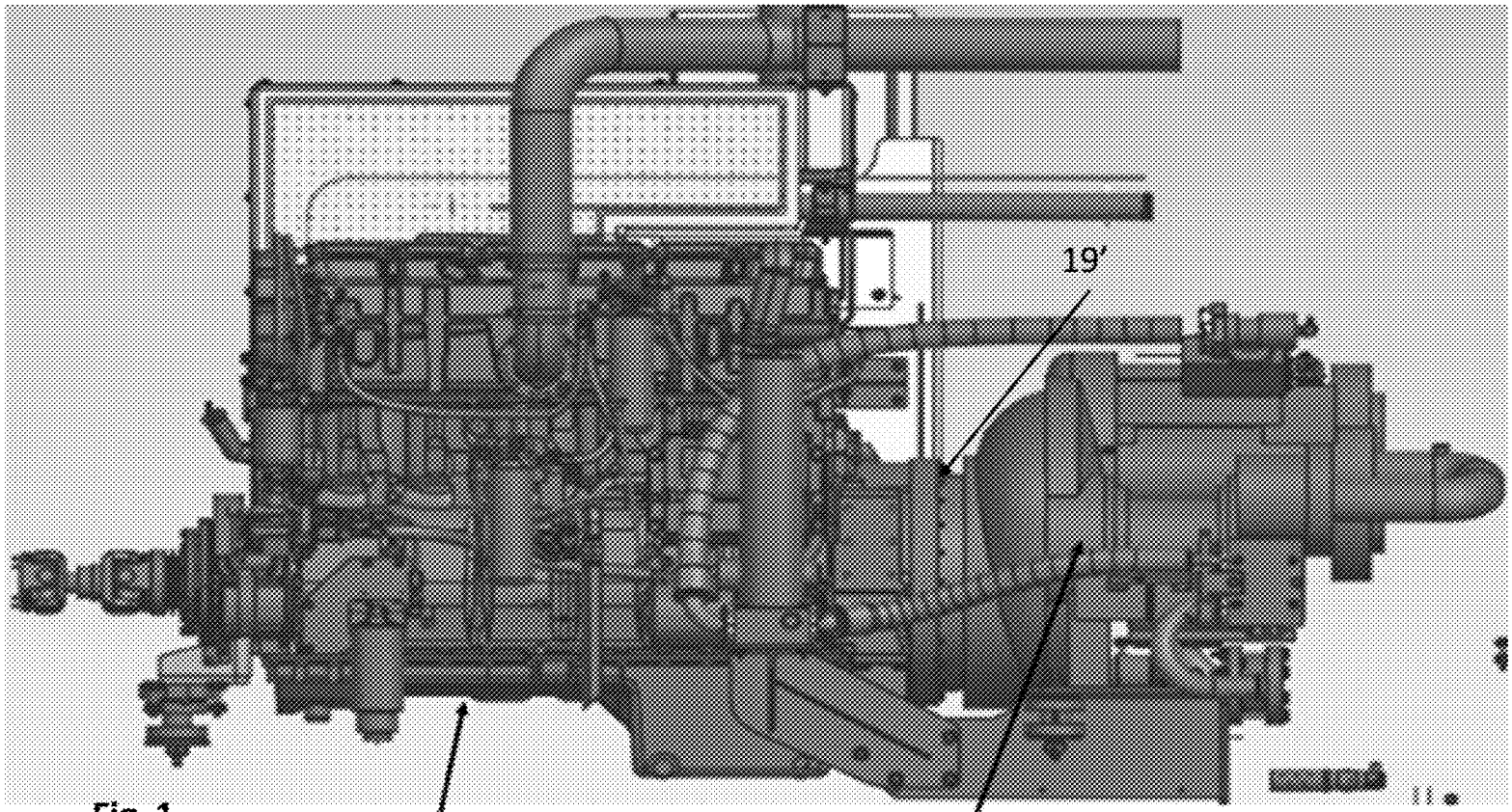
Fig. 1 Prior Art:
FIG. 1 is a side perspective view of a known diesel engine connected to an air compressor.
Figure 2:
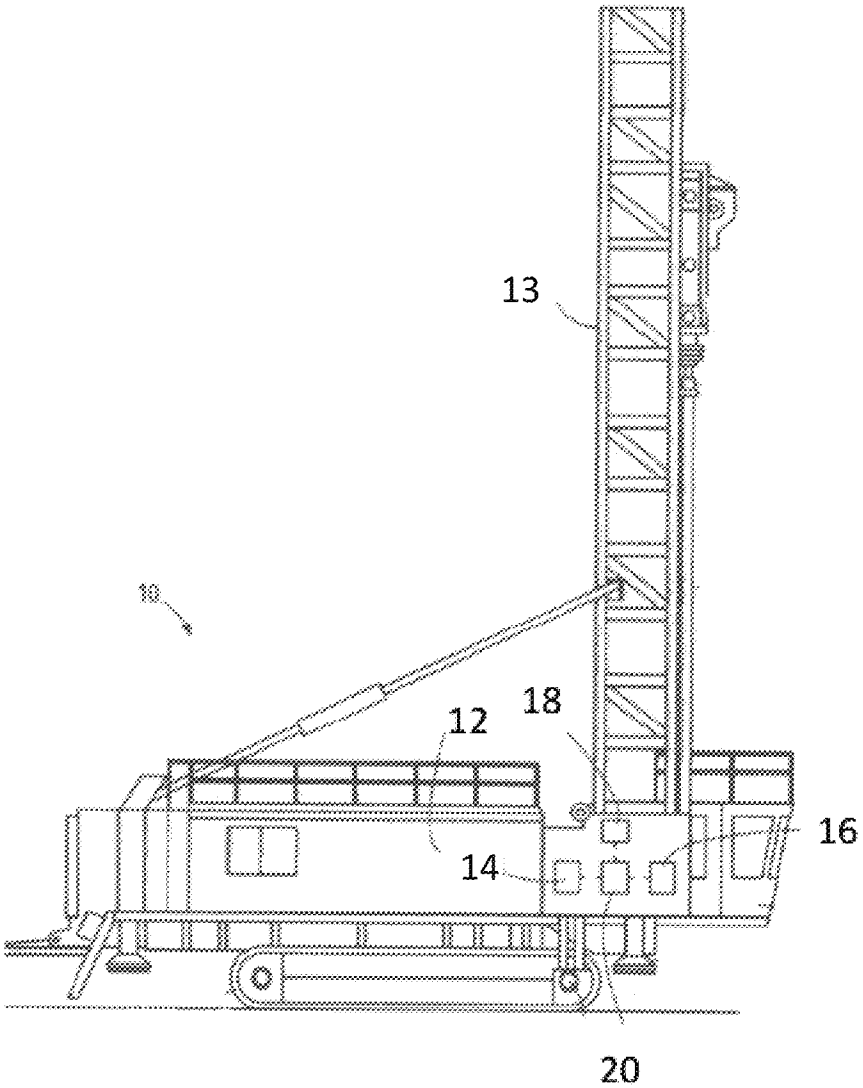
FIG. 2 is a perspective view of a blast hole rig having a blasthole drill compressor connection system according to the present disclosure.

Referring to FIG. 2, a blast hole drill rig 10 includes a base 12 and a drill tower 13. Included in base 12 is an engine 14 and a compressor 18. Engine 14 is referred to as an engine herein, however, it should be appreciated that engine 14 can be any kind of source of power, such as a diesel or gasoline engine or an electric motor. Compressor 18 is of a known type such as an air compressor, but it should be appreciated that the present disclosure contemplates different types of compressors as well.

Compressor 18 includes a compressor output port (not shown), which is in fluid communication with a rotary head of the drill. Engine 14 includes a flywheel (not shown) that rotates in response to the rotation of a crank shaft (not shown) thereof. As is commonly known, the crank shaft rotates when the engine is operating, and hence, the rotation and rotation speed of the flywheel corresponds to the rotation of the engine.

Compressor 18 operates in response to engine 14 being operated when it is operatively coupled to the engine. Thus, as discussed above, engine 14 consumes more energy when compressor 18 is operatively coupled thereto.

Figure 3:
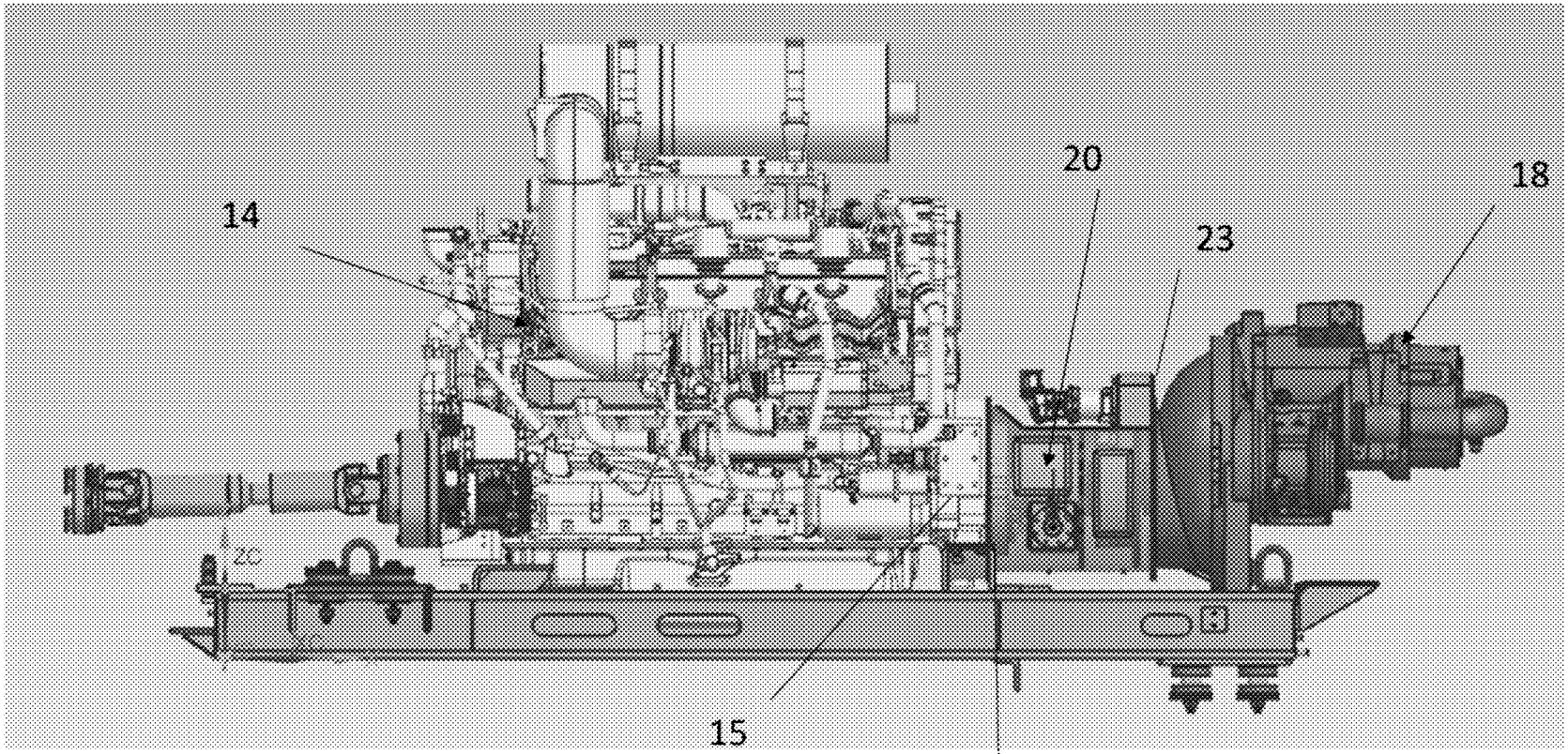
FIG. 3 is a side perspective view of a compressor drive connection system according to the present disclosure.

Referring to FIG. 3, engine 14 includes a compressor coupling 15. Coupling 15 includes a flywheel (not shown) that rotates in response to the rotation of the crank shaft (not shown) of engine 14 when connected thereto.

Coupled between coupling 15 of engine 14 and compressor 18 is a connection assembly 20, which will be described in further detail below.

Compressor 18 is coupled to connection assembly 20, as will also be described further herein. Compressor 18 has a drive shaft (not shown). The compressor drive shaft is mechanically coupled to assembly 20. It should be appreciated that connection assembly can be directly connected to compressor 18 or via another coupling arrangement.

Connection assembly 20 can be operatively coupled to engine 14 and compressor 18 in a number of different ways. For example, via known standards for coupling an engine fly wheel and fly wheel housing to rotating equipment such as rubber flex joints, steel and nylon flex plates, coil spring torsional dampers. The final determination will be result of space constrains, torque strengths and torsional vibration analysis and testing.

Thus, as connection assembly 20 is coupled between engine 14 (via coupling 15) and compressor 18, it also acts as a disconnect assembly, which enables engine 14 to consume less energy when the connection assembly is in the disengaged condition, even though compressor 18 is operatively coupled to the engine through the connection assembly 20.

Figure 4A:
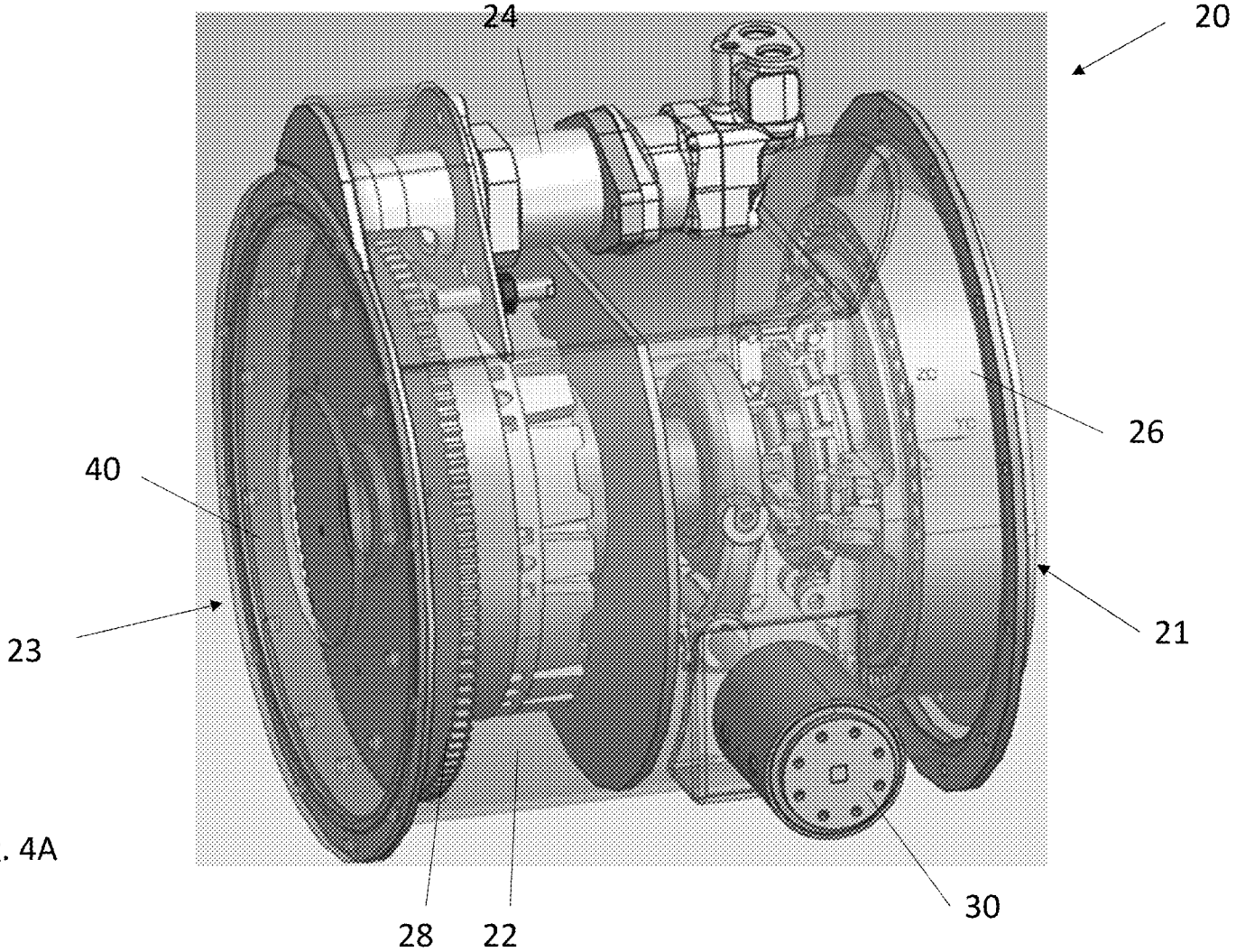
FIG. 4A is a perspective view of the connection assembly with a transparent enclosure.
Figure 4B:
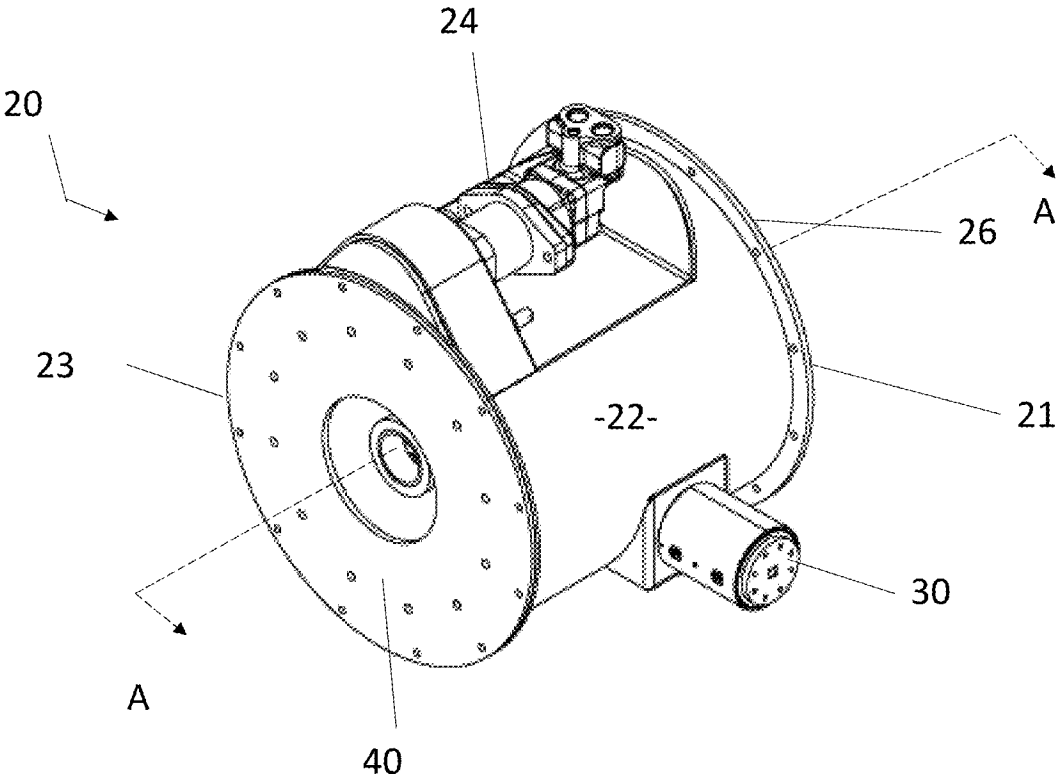
FIG. 4B is a perspective view of the connection assembly.

FIG. 4*a* is a perspective view of connection assembly 20, with a housing 22 thereof being shown in an imaginary transparent view. FIG. 4B is a perspective view of the connection assembly 20. As shown in FIGS. 4A and 4B, housing 22 extends between opposed first and second ends 21, 23, respectively.

Connection assembly 20 includes a clutch 26 disposed at first end 21, which is positioned to engage the engine as described above. The other end 23 of connection assembly 20 is positioned towards compressor 18 as described above. A flexible rubber coupling can be arranged between the compressor 18 and assembly 20.

Clutch 26 can be of many different types. For example, a power-take-off (PTO) dry clutch. One type of dry clutch is a power take off manufactured by WPT Power Corporation of Wichita Falls, Texas.

As described above, connection assembly 20 is used to operatively couple engine 14 and compressor 18. In this way, in response to the operation of compressor 18, clutch 26 acts between an engaged and disengaged condition in a known manner. Further, the amount of energy consumed by engine 14 is controllable in response to moving clutch 26 between the engaged and disengaged conditions.

It should be noted that the movement of the clutch is controlled by control system 16, which will be described further herein.

Figure 5:
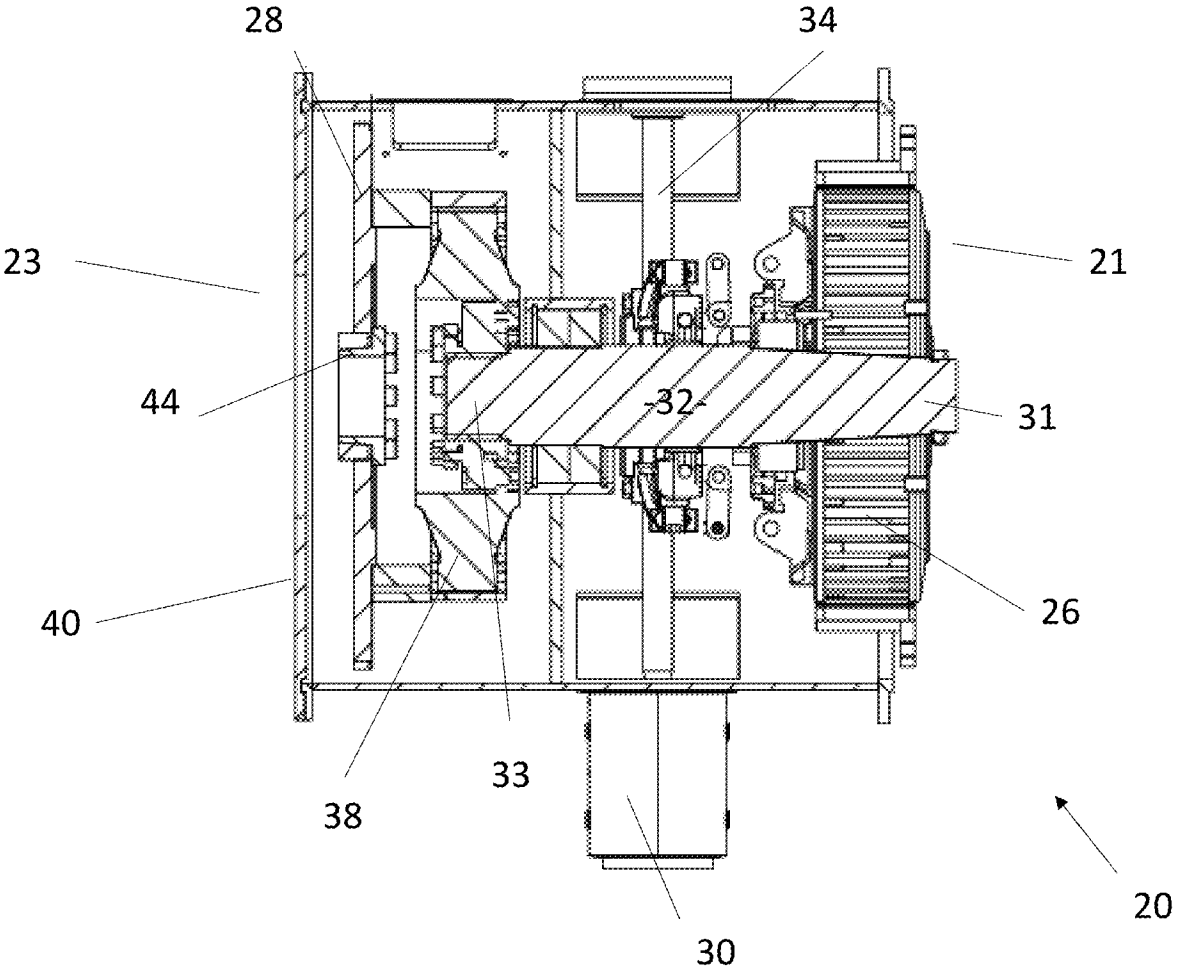
FIG. 5 is a cross-sectional view of the connection assembly taken along line A-A of FIG. 4B.
Figure 6:
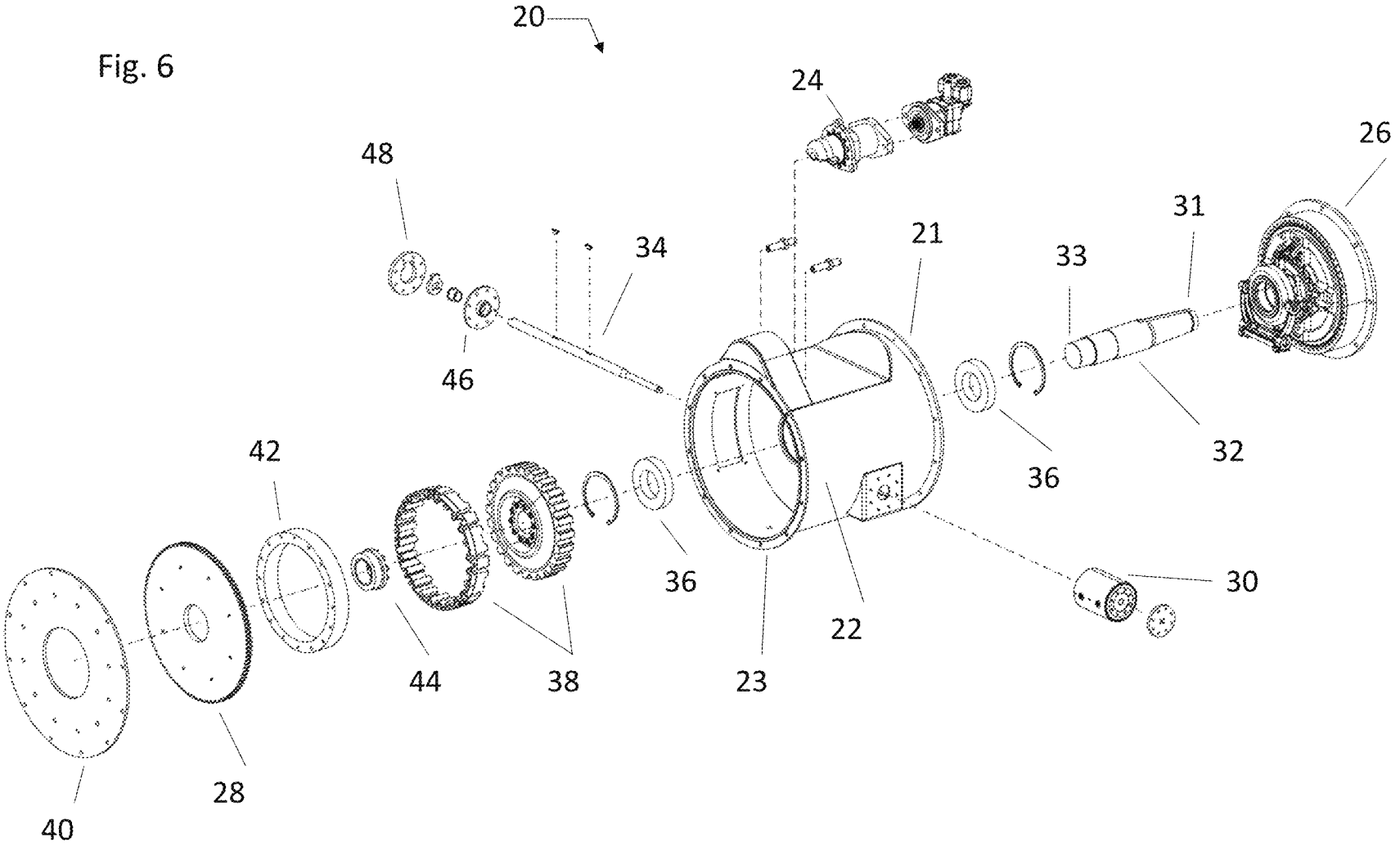
FIG. 6 is an exploded view of the connection assembly of FIG. 4*b*.

Connection assembly 20 is described in more detail according to FIGS. 5 and 6. A shaft 32 having a first end 31 connects to a clutch plate of clutch 26. Second end 33 of shaft 32 engages a coupler 38. Shaft end 33 is positioned towards the compressor at end 23 of connection assembly 20 and shaft end 31 is positioned towards end 21 at the engine or engine coupling.

Toothed coupler 38 engages with shaft end 33 via bearing 36. The bearing 36 centralizes the shaft. The tooth coupler is clamped to shaft end 32 by a tapered wedge clamp that is part of this rubber toothed coupling. A gear spacer extends between coupler 38 and ring gear/flywheel 28. Thus, ring gear 28 is attached to the output of clutch 26.

A shaft and hub locker 44 clamps shaft end 33 and flywheel starter gear 28. An adaptor plate 40 is provided at end 23 to enclose housing 22 and provide a rigid mounting to the compressor.

In addition to engaging and disengaging, the present connection assembly 20 is arranged to bring the compressor up to the speed of the engine before the clutch is engaged. Thus, there is no starting torque to cause slippage or frictional heat.

Accordingly, connection assembly 20 includes a hydraulic motor starter 24 connected to flywheel ring gear 28, which as described above, is connected to shaft 32, which is coupled to compressor 18. For example, shaft 32 can be a keyed shaft with a clamping method to connect the ring gear and clutch. The hydraulic motor is only connected during starting of the compressor. The hydraulic motor has a standard starter, such as a Bendix starter, that causes the gear in the starter to move axially along it's shaft to engage the gear ring/flywheel while the hydraulic motor is rotating.

Starter 24 includes a motor that has a hydraulic soft start valve (not shown). As discussed above, the hydraulic motor is only connected during starting of the compressor. The standard starter Bendix causes the gear in the starter to move axially along it's shaft to engage the gear ring/flywheel while the hydraulic motor is rotating. For example, the soft starter is a hydraulic logic element that engages the starter Bendix slowly until the gear teeth in the Bendix pinion fully engage the flywheel teeth 28. Once fully engaged the hydraulic motor goes to full speed and torque. This logic protects the pinion and flywheel gear teeth from hard engagements and extends their life.

The soft start valve ensures engagement of the pinion to ring gear 28 before full pressure is applied, reducing failure of the gear teeth.

Hydraulic starter 24 can fit in the same location on engine 14 as a standard electrical starter, and has a significantly longer life than an electrical starter. Hydraulic starter 24 engages ring gear 28 to increase the rotational rpm of the compressor. When starter 24 engages ring gear 28 it speeds up the compressor's rpm until compressor 18 and clutch 26 connected to the engine flywheel (not shown) are at the same speed. Once the engine and the compressor are at the same rotational speed (rpm) the clutch is then engaged, for example, via control system 16.

A hydraulic rotary actuator 30 is connected to the clutch shaft 32 via actuator shaft 34 to engage and disengage the clutch. For example, a standard over center clutch actuated by lever.

When the clutch is at the same RPM as the engine and compressor no slipping or wear occurs due to the rev matching of the system.

The engine 14, compressor 18 and other components of the drill, such as the movement of clutch 26, can be controlled with control system 16, such as a dedicated logic controller or part of the rig control system that both use, for example, a SAE J1939 communication protocol.

The control system once signaled to start the compressor by the operator would slow the engine rpm to around 1000 rpm and at the same time engage hydraulic valves would cause hydraulic oil to flow to the starter causing it to engage the ring gear and start rotating the compressor. The control system would know the engine rpm via a bus, it would also have a rpm rotational speed sensor on the compressor reporting the compressor RPM. Once the engine and compressor are within a desired differential rpm tolerance the controller would send a control signal to a hydraulic valve that would drive the clutch to the engaged position. During engagement if the desired rpm matching is not obtained or falls out of the desired range corrective actions can be taken, such as reengaging the clutch or disengaging the clutch. It should be appreciated that all mechanical operations can be electrical, as well as hydraulic.

As set forth above, the compressor will be brought up to speed of the engine before the clutch is engaged. Thus, there is no starting inertia (torque) to cause slipping wear or frictional heat. The present system eliminates frictional wear in the clutch, extending the clutch's operating life to exceed the life of the engine and air compressor. Without the rotational speed matching operation, the clutch would wear out and need replacing.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A drill rig comprising:

an engine;

a compressor; and a connection assembly coupled between the engine and the compressor, the connection assembly including a ring gear coupled to the compressor and a clutch connected to the engine, wherein a starter is connected to the ring gear and arranged to engage the ring gear to rotate the compressor to a predetermined rotation speed before the clutch is engaged, wherein the predetermined rotation speed of the compressor is the same as a speed of the engine.

2. The drill rig of claim 1, wherein the starter is a hydraulic starter arranged to engage the compressor.

3. The drill rig of claim 1, further comprising a hydraulic rotary actuator connected to the clutch to engage and disengage the clutch.

4. The drill rig of claim 1, wherein the clutch is a dry clutch.

5. The drill rig of claim 1, further comprising a control system arranged to operate the engine, compressor, and engagement of the clutch.

6. The drill rig of claim 1, wherein the compressor is an air compressor.

7. A compressor drive system arranged to selectively operate a compressor and engine of a drill rig, the compressor drive system comprising:

a connection assembly coupled between the engine and the compressor, the connection assembly including a ring gear arranged to be coupled to the compressor and a clutch arranged to be connected to the engine, wherein a starter is connected to the ring gear and arranged to engage the ring gear to rotate the compressor to a predetermined rotation speed before the clutch is engaged, wherein the predetermined rotation speed of the compressor is the same as the speed of the engine.

8. The compressor drive system of claim 7, wherein the starter is a hydraulic starter arranged to engage the compressor.

9. The compressor drive system of claim 7, further comprising a hydraulic rotary actuator connected to the clutch to engage and disengage the clutch.

10. The compressor drive system of claim 7, wherein the clutch is a dry clutch.

11. The compressor drive system of claim 7, further comprising a control system arranged to operate the engine, compressor, and engagement of the clutch.

12. The compressor drive system of claim 7, wherein the compressor is an air compressor.

13. A method of controlling fuel and energy consumption and component wear in a drill rig, the drill rig including an engine and a compressor, the method comprising the steps of:

providing a connection assembly coupled between the engine and the compressor, the connection assembly including a ring gear arranged to be coupled to the compressor and a clutch arranged to be connected to the engine, wherein a starter is connected to the ring gear and arranged to engage the ring gear to rotate the compressor to a predetermined rotation speed;

starting the starter to engage the ring gear and start rotating the compressor;

sensing the rotation speed of the compressor;

sensing the rotation speed of the engine;

determining when the rotation speed of engine and compressor are the same; and sending a control signal to the starter to drive the clutch to an engaged position when the rotation speed of the compressor is the same as the speed of the engine.

* * * * *